United States Patent [19]

Kotaka

[11] 4,092,504

[45] May 30, 1978

[54] ELECTRICAL SLIDE SWITCH WITH SELF-CENTERING FLEXIBLE CONTACT

[75] Inventor: Yasumasa Kotaka, Takatsu, Japan

[73] Assignee: AMP Incorporated, Harrisburg, Pa.

[21] Appl. No.: 750,479

[22] Filed: Dec. 14, 1976

[30] Foreign Application Priority Data

Dec. 18, 1975 United Kingdom ..... 51987/75

[51] Int. Cl.[2] ..... H01H 15/00

[52] U.S. Cl. ..... 200/16 D

[58] Field of Search ..... 200/16 C, 16 D, 252–261, 200/284, 303, 333, 334, 257, 258

[56] References Cited

U.S. PATENT DOCUMENTS

| | | | |
|---|---|---|---|
| 3,883,705 | 5/1975 | Sebastian et al. | 200/333 X |
| 3,974,346 | 8/1976 | Keprda | 200/333 X |
| 3,974,347 | 8/1976 | Lockard | 200/252 X |
| 3,978,298 | 8/1976 | Fukuda et al. | 200/334 X |
| 4,012,608 | 3/1977 | Lockard | 200/16 D |

*Primary Examiner*—James R. Scott

*Attorney, Agent, or Firm*—Allan B. Osborne

[57] ABSTRACT

The present invention relates to a slide switch having one or more manually actuated switches of miniature size adapted for use on a printed circuit board or the like. More particularly, the invention includes a channel-containing base, two face to face strip form contacts in the channel with legs thereon depending from opposite edges of the base. A cover contains a slidable spring carrier which in turn carries a spring having a conductive limb thereon for removable engagement with the two face to face contacts thereby completing a circuit from one contact to the other.

1 Claim, 4 Drawing Figures

ELECTRICAL SLIDE SWITCH WITH SELF-CENTERING FLEXIBLE CONTACT

BACKGROUND OF THE INVENTION

1. Field of the Invention

The present invention is in the field of slide switches wherein two contacts are electrically connected by means of a sliding conducting member.

2. Prior Art

U.S. Pat. No. 3,974,346 exemplifies slide switches of the type disclosed herein. The sliding member removably electrically connects two stationary contacts so as to complete a circuit therethrough. U.S. Pat. No. 4,012,608 is another example of slide switches.

SUMMARY OF THE PRESENT INVENTION

The present invention provides a base of insulating material having one or more channels extending inwardly from both longitudinal sides. A strip form contact is positioned in each channel with a first free end depending from the base and the second free end facing towards the second free end of the contact in the opposing channel. The cover includes one or more carriers, each carrier being slidably positioned over two opposing channels. The carriers carry a hairpin-shaped spring having a first limb which slides in and out of engagement with the contacts positioned in the opposing channels. The free end of the second limb has a right angle bend which fits into a carrier cavity. The carrier has a arm extending up through an aperture in the cover for manual operation of the switch.

The second free ends of the contacts are formed into an arcuate or part-cylindrical shape as is the free end of the first limb on the hairpin-shaped spring. The free end of the second limb fits loosely in the carrier cavity so that the inter-action between the contacts and first limb on the spring results in a self-centering switch.

The self-centering feature ensures adequate electrical contact in spite of possible variations in manufacturing tolerances.

BRIEF DESCRIPTION

A specific example of a multiple slide switch according to the invention will now be described with reference to the accompanying drawings in which:

FIG. 1 is a cross-sectional view of the switch;

FIG. 1*a* is a cross-sectional view showing the housing of the contacts in the base;

DESCRIPTION OF THE INVENTION

Figure 1:
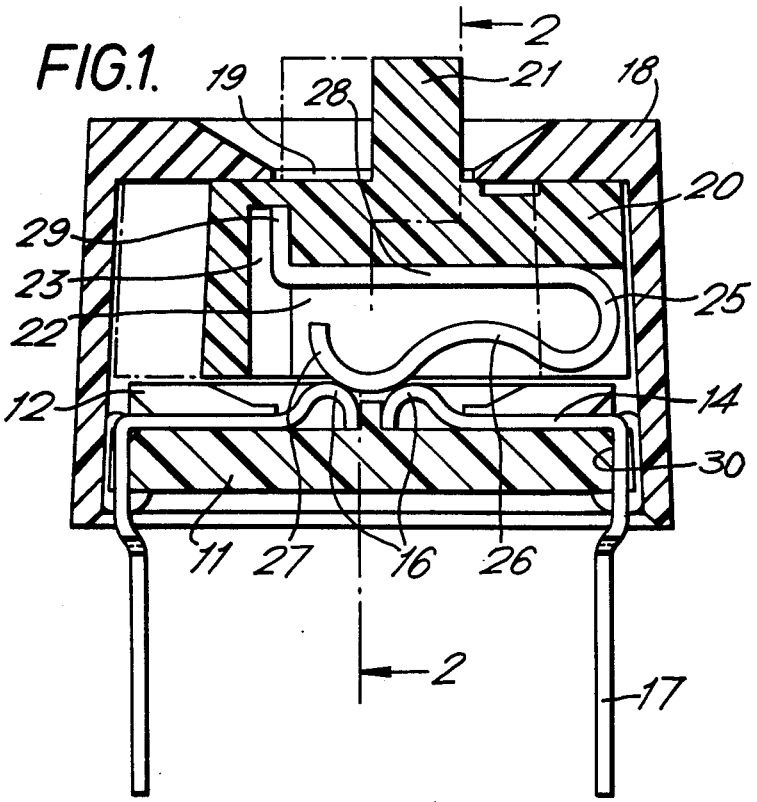

The switch comprises an insulating base 11 moulded from plastics material with a series of channels 12 extending across the base, the walls of each channel being formed with blind-ended slots 13 opening to edges of the base. The edges of the base are rebated at the channel floors as indicated by reference numeral 30.

A pair of stamped and formed metal contacts 14 is located in each channel with lateral wings 15 of the contacts received in associated slots. Each contact is formed at one end with a part-cylindrical contact surface 16 and at the other with a leg 17. The contacts of each pair are bent intermediate their ends to lie in opposite rebates which define apertures through the base so that the legs project out of the housing base and the contact surfaces 16 are adjacent.

A box-like cover 18 is moulded from plastics material with a series of apertures 19.

A series of spring carriers 20 is located within the cover, each spring carrier being moulded from plastics material with a spring receiving compartment 22 open to a bottom and one end. The compartment is extended upwardly to form a cavity 23. An operating arm 21 is provided on the carrier and extends upwardly through the aperture 19.

A metal slider spring 25 is sandwiched in prestressed condition between the contacts and the carrier with a longitudinal axis of the spring extending generally parallel to the axis of the base. The spring is stamped and formed to hairpin shape, one limb 26 being of sinuous shape terminating in a part-cylindrical contact surface 27 at one end, the other end 29 of the other limb 28 being bent at right-angles and located freely in the cavity 23.

The spring can be slid by the operating arm between switch positions in which the curved contact engages one or both contact surfaces 16. As all three contact surfaces are part-cylindrical and as the end 29 of the spring is freely located, the spring is self-centering between the contact surfaces 16. The sinuous shape of the one spring arm ensures clearance over the contact surfaces and assists in producing a spring force characteristic which is relatively independent of the separation of the limbs during switching movement.

Figure 3:
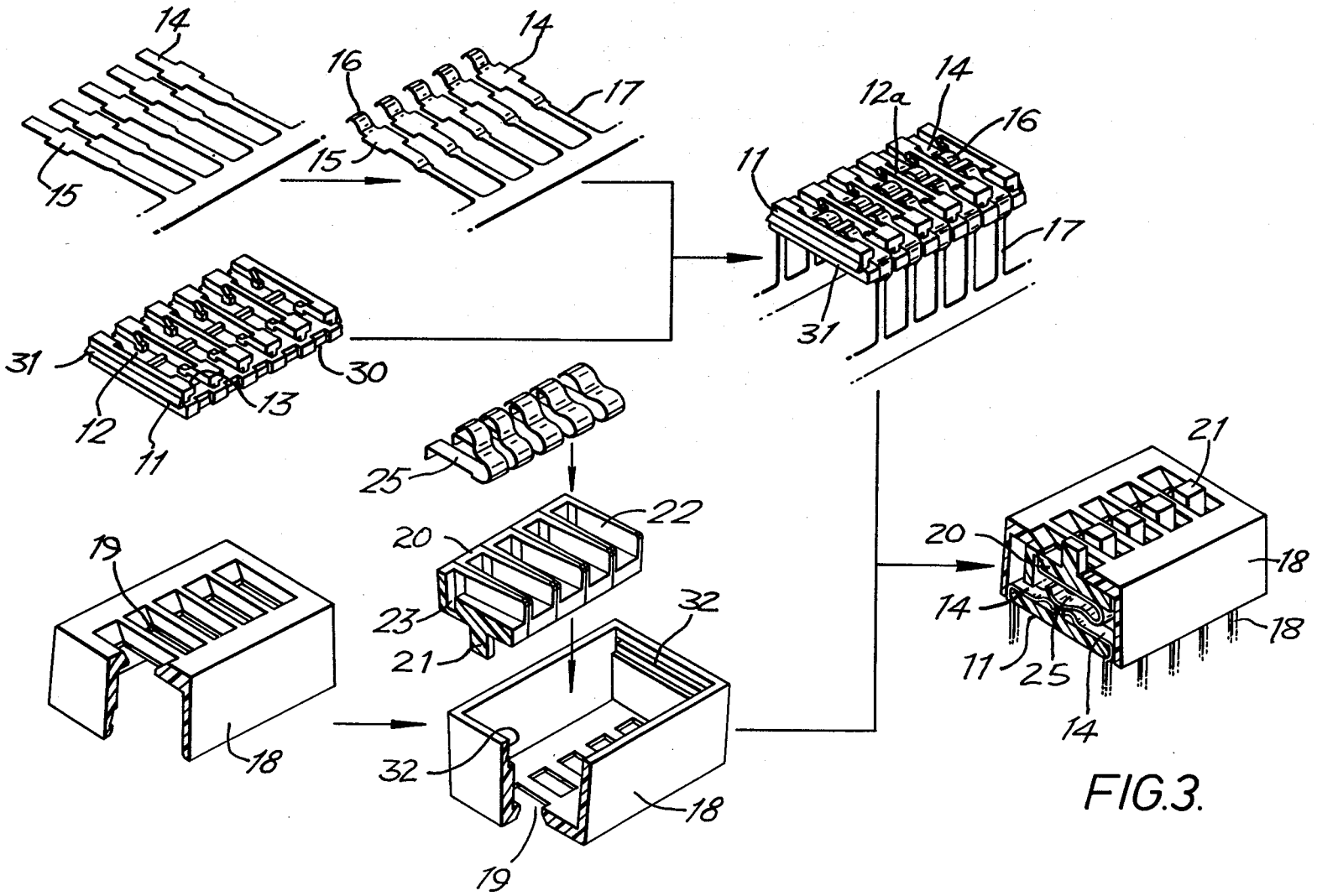
FIG. 3 is a perspective view showing the switch components at various stages of assembly.

The switch is suitable for manufacture by mass production techniques using automatic assembly. As shown in FIG. 3, the contacts are located in the base while still in ladder-strip form and then bent at right-angles intermediate their ends to retain them in the base. The slider member and spring are then located in the cover while all three are inverted and the sub-assembly of contact and base then inverted and mounted on the cover.

Figure 2:
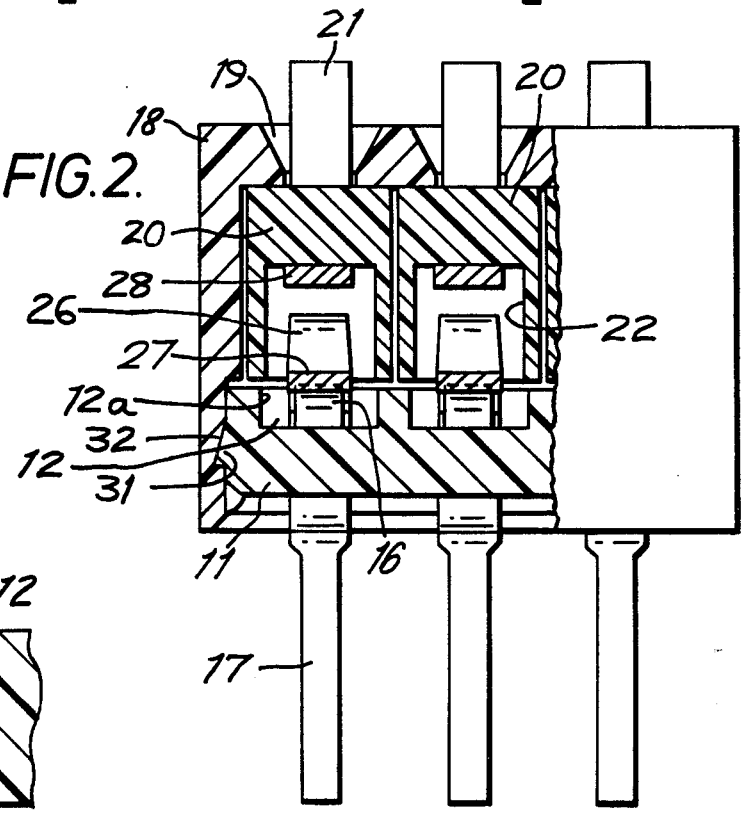
FIG. 2 is a cross-sectional view perpendicular to FIG. 1.
Figure 1A:
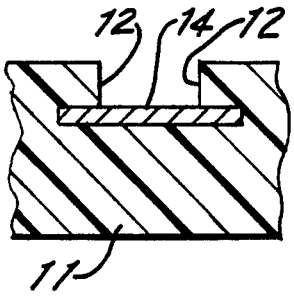

Cover 18 may be fastened to base 11 by means of projection 31 on the ends of the base and corresponding grooves 32 on the inside end surfaces of the cover as shown in FIG. 2.

The foregoing detailed description has been given for clearness of understanding only, and no unnecessary limitations should be understood therefrom, as some modifictions will be obvious to those skilled in the art.

What is claimed is:

1. A slide switch comprising:

a. a base of insulating material having a plurality of channels each extending across the upper surface, further a plurality of apertures positioned adjacent the outer edges of each channel and extending vertically through the base;

b. a plurality of contacts stamped and formed from conductive material, each having a first part providing a leg and a second part providing a contact surface at its free end, said parts being generally at right angles one to the other, said leg extending through an aperture and depending from the base, said second part positioned in the channel with the contact surface facing inwardly and formed into a part cylindrical shape opening downwardly, said contact surface being located near the contact surface of a contact positioned in the same channel and extending inwardly from the opposite side;

c. a box-like cover of insulating material having apertures spaced along its upper surface and mounted on the base thereby providing an interior space, said apertures being in alignment with the channels on the base surface;

d. a plurality of carriers of insulating material, each positioned in the interior space in alignment with an overhead aperture and underlying channel, each carrier having an arm extending through an aperture and a vertical cavity in the undersurface adjacent one end; and e. a plurality of hairpin-shaped springs stamped and formed from conductive material, each positioned between a channel and an overlying carrier, a first limb of each spring being sinuous with the free end thereof formed in a part cylindrical shape opening upwardly and being in removable electrical engagement with one or both of the contact surfaces in the underlying channel, and a second limb having its free end bent upwardly at right angles thereto and loosely positioned in the carrier cavity to permit limited sliding movement of the spring independent of the carrier movement so that as the carrier moves the part cylindrical free end on the spring's first limb into engagement with the two facing contact surfaces, the part cylindrical free end centers itself thereinbetween.

* * * * *